United States Patent [19]

Thorn

[11] Patent Number: 4,550,540

[45] Date of Patent: Nov. 5, 1985

[54] COMPRESSION MOLDED DOOR ASSEMBLY

[75] Inventor: John E. Thorn, Sylvania, Ohio

[73] Assignee: Therma-Tru Corp., Toledo, Ohio

[21] Appl. No.: 594,549

[22] Filed: Mar. 29, 1984

Related U.S. Application Data

[63] Continuation-in-part of Ser. No. 456,400, Jan. 7, 1983, abandoned.

[51] Int. Cl.[4] ..... E06B 3/36

[52] U.S. Cl. ..... 52/309.4; 52/313; 52/456; 52/809

[58] Field of Search ..... 52/309.4, 309.6, 309.9, 52/313, 316, 456, 455, 474, 785, 809; 49/501, 503

[56] References Cited

U.S. PATENT DOCUMENTS

| | | | |
|---|---|---|---|
| 2,849,758 | 9/1958 | Plumley | 20/15 |
| 2,871,056 | 1/1959 | Levitt | 296/106 |
| 2,890,977 | 6/1959 | Bayer | 154/110 |
| 2,924,860 | 2/1960 | Parham | 20/35 |
| 3,153,817 | 10/1964 | Pease | 20/35 |
| 3,225,505 | 12/1965 | Lytz | 20/35 |
| 3,250,041 | 5/1966 | Anger | 49/501 |
| 3,299,595 | 1/1967 | Munk | 52/309 |
| 3,402,520 | 9/1968 | Lee et al. | 52/309 |
| 3,498,001 | 3/1970 | MacDonald | 49/501 |
| 3,512,304 | 5/1970 | Meuret | 49/501 |
| 3,546,841 | 12/1970 | Smith | 52/309 |
| 3,593,479 | 7/1971 | Hinds | 52/313 |
| 3,772,241 | 11/1973 | Kroekel | 260/40 R |
| 3,883,612 | 5/1975 | Pratt | 260/862 |
| 3,950,894 | 4/1976 | DiMaio | 49/501 |
| 3,961,012 | 6/1976 | DiMaio | 264/257 |
| 4,022,644 | 5/1977 | Smith | 52/309.4 X |
| 4,132,042 | 1/1979 | DiMaio | 52/309 |
| 4,152,876 | 5/1979 | Seely | 52/455 |
| 4,265,067 | 5/1981 | Palmer | 52/309.9 |

FOREIGN PATENT DOCUMENTS

| | | | |
|---|---|---|---|
| 2304763 | 10/1976 | France | 52/309.9 |
| 1420244 | 1/1976 | United Kingdom . | |
| 1487309 | 9/1977 | United Kingdom . | |
| 2044316 | 10/1980 | United Kingdom | 52/309.9 |
| 604937 | 4/1978 | U.S.S.R. | 52/309.9 |

*Primary Examiner*—J. Karl Bell

*Attorney, Agent, or Firm*—Emch, Schaffer, Schaub & Porcello

[57] ABSTRACT

A compression molded door assembly is disclosed. A pair of compression molded skins are mounted on a rectangular perimeter frame which extends outwardly from the edges of the skins. The compression molded skins include a molding resin and reinforcing glass fibers. The outer surface of the skin is essentially devoid of glass fibers for a predetermined distance. A foamed core is positioned within the frame in adhering relationship to the opposed skins. A texture is molded on the exterior of the skins which simulates the grain and texture of a wood door.

13 Claims, 9 Drawing Figures

COMPRESSION MOLDED DOOR ASSEMBLY

RELATED APPLICATIONS

This application is a continuation-in-part of application Ser. No. 456,400, filed Jan. 7, 1983 now abandoned.

BACKGROUND OF THE INVENTION

Attempts have been made in the past to construct various types of door assemblies. A door assembly which is installed as an exterior door should be dimensionally stable to reduce energy losses through the opening. Relatively severe temperature differentials occur on such exterior door assemblies. One of the major problems with prior art door assemblies has been excessive deflection and warping caused by such temperature differentials. Traditional wood doors suffer from splitting and cracking in addition to long-term moisture absorption which results in warping.

Another problem which has not been resolved by prior art door assemblies is the appearance of the door. In situations where simulated wood door appearances have been desired, attempts have been made to obtain the "wood" appearance through the use of veneers and other surface treatments. Customers are generally familiar with the texture and the differences in graining of a wood door. Therefore, unless this same type of texture and graining, for example edge graining, is duplicated, the simulated wood door assembly is unsatisfactory from an appearance viewpoint.

Another problem is the installation of a door assembly. In the rehabilitation market and even in new construction, it is often necessary to trim the door assembly prior to installation within the door frame. This was often difficult to do when using prior art door assemblies.

Sizing of the door or fitting door lites often require special metal working tools. The present invention permits the use of standard tools, although carbide-tipped tools are recommended for multiple installations where the same tools are used.

SUMMARY OF THE INVENTION

The present invention is a compression molded door assembly having compression molded skins which are mounted on a rectangular perimeter frame. A fine texture is molded in the exterior surfaces of the skin to simulate both the texture and the grain of a wood door. The compression molded skins include a thermosetting resin and glass fiber reinforcement. The outer surface of the skin is essentially devoid of glass fibers to a predetermined depth and the simulated textured pattern is applied in the resin rich area to a depth of between 0.003 and 0.009 inches. A textured surface is often also molded on the interior side of each skin. The perimeter frame extends outwardly from the edges of the skins to allow for trimming of the door assembly.

A foamed core, for example a urethane foam, is positioned within the frame in an adhering relationship with the opposed compression molded skins and the frame.

The present invention has as its primary object a compression molded door assembly having a close simultation on its exterior to a wood door, both in texture and grain.

Another object of the present invention is to provide a compression molded door assembly which can be trimmed for insertion in an opening.

Still another object of the present invention is a compression molded door assembly which resists permanent deflection and warping when exposed to temperature differentials and humidity.

DETAILED DESCRIPTION OF THE DRAWINGS

DETAILED DESCRIPTION OF THE PREFERRED EMBODIMENT

Figure 1:
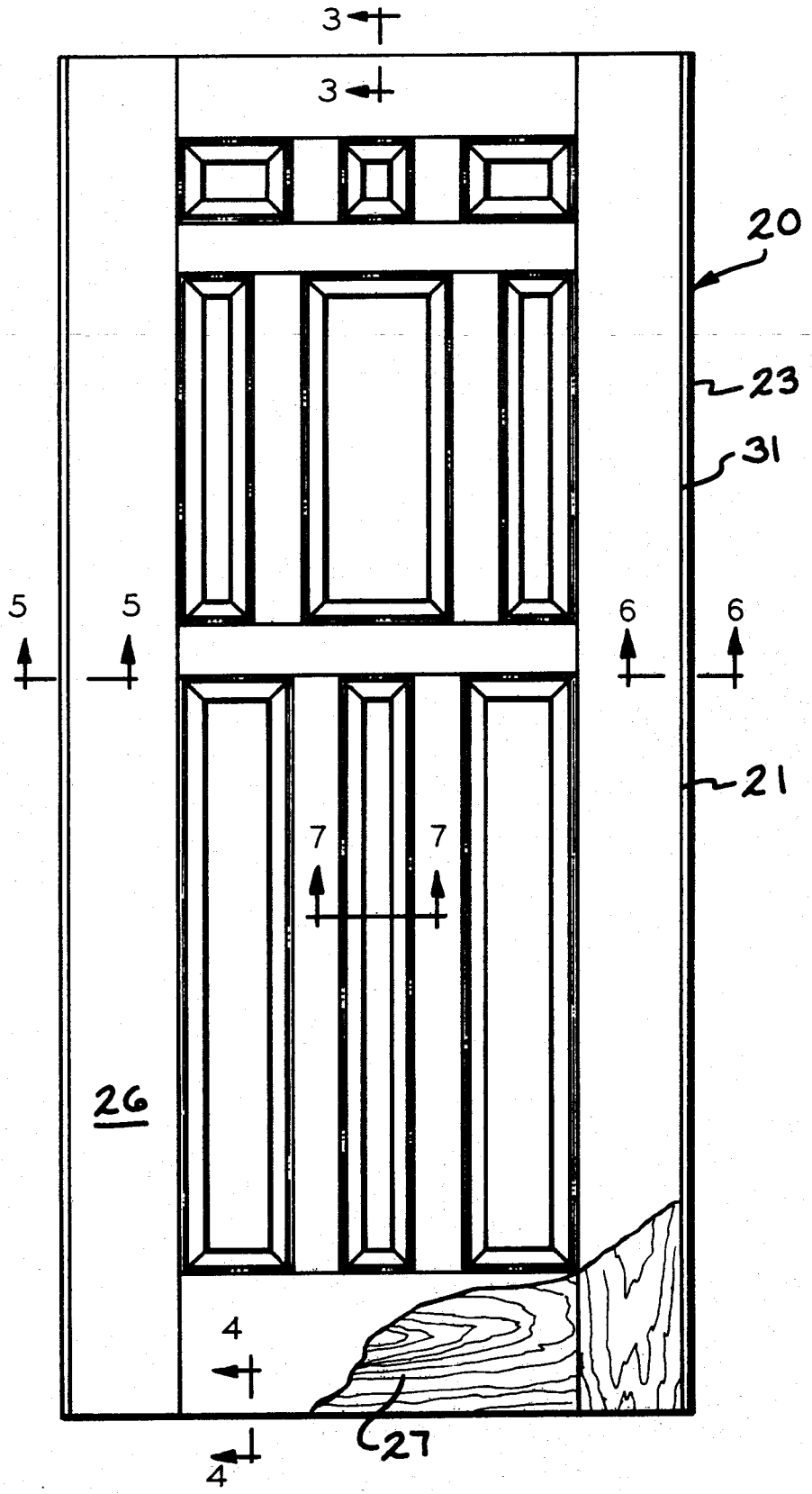
FIG. 1 is an elevational view of a compression molded door assembly, according to the present invention, showing the simulated wood texture in the lower right-hand corner.

A compression molded door assembly, according to the present invention, is generally indicated by the reference number 20 in FIG. 1. The compression molded door assembly 20 includes a pair of opposed compression molded door panels or skins 21, 22, which are attached to a perimeter frame 23. The interior of the perimeter frame 23 is filled with a foam core 24 which is adhered to the skins 21, 22.

Each of the skins 21, 22 is a compression molded sheet molding compound (SMC) panel, which includes 15% to 40% fibrous glass reinforcement, by weight, and 10% to 40% inert mineral filler, by weight, in the molding resin. Unsaturated polyester polymers blended with vinyl monomers such as styrene are molding resins that may be cured under heat and pressure to form the thermoset compression molded skins. The molding compounds or molding resins include unsaturated polyester resinous compositions and modifications as disclosed in U.S. Pat. No. 3,772,241 to Charles H. Kroekel and in U.S. Pat. No. 3,883,612 to Ivor Pratt et al. The inert filler can be, for examples, calcium carbonate or alumina trihydrate. In some embodiments, the material may also include ultraviolet stabilizers and fire retardant additives in the composition. Each of the skins 21, 22 has a thickness of between 0.050 inch and 0.120 inch. The present embodiment shown in FIG. 2, has a skin thickness of 0.070 inch.

Referring to FIG. 1, an exterior side 26 of the skin 21 includes a molded wood grained texture 27. The texture 27 is very important and simulates both from a texture viewpoint and a graining viewpoint that of a wood door, which has been assembled from wood components consisting of stiles, rails, raised and carved panels. The texture 27 on the exterior side 26 is between 0.003 inch and 0.009 inch in depth. The outer or exterior side 26 of the skin 21 is essentially devoid of glass fibers for a predetermined depth of at least 0.005 inch. This predetermined depth where the outer side 26 is essentially devoid of glass fibers is normally between 0.005 inch and 0.009 inch.

Figure 2:
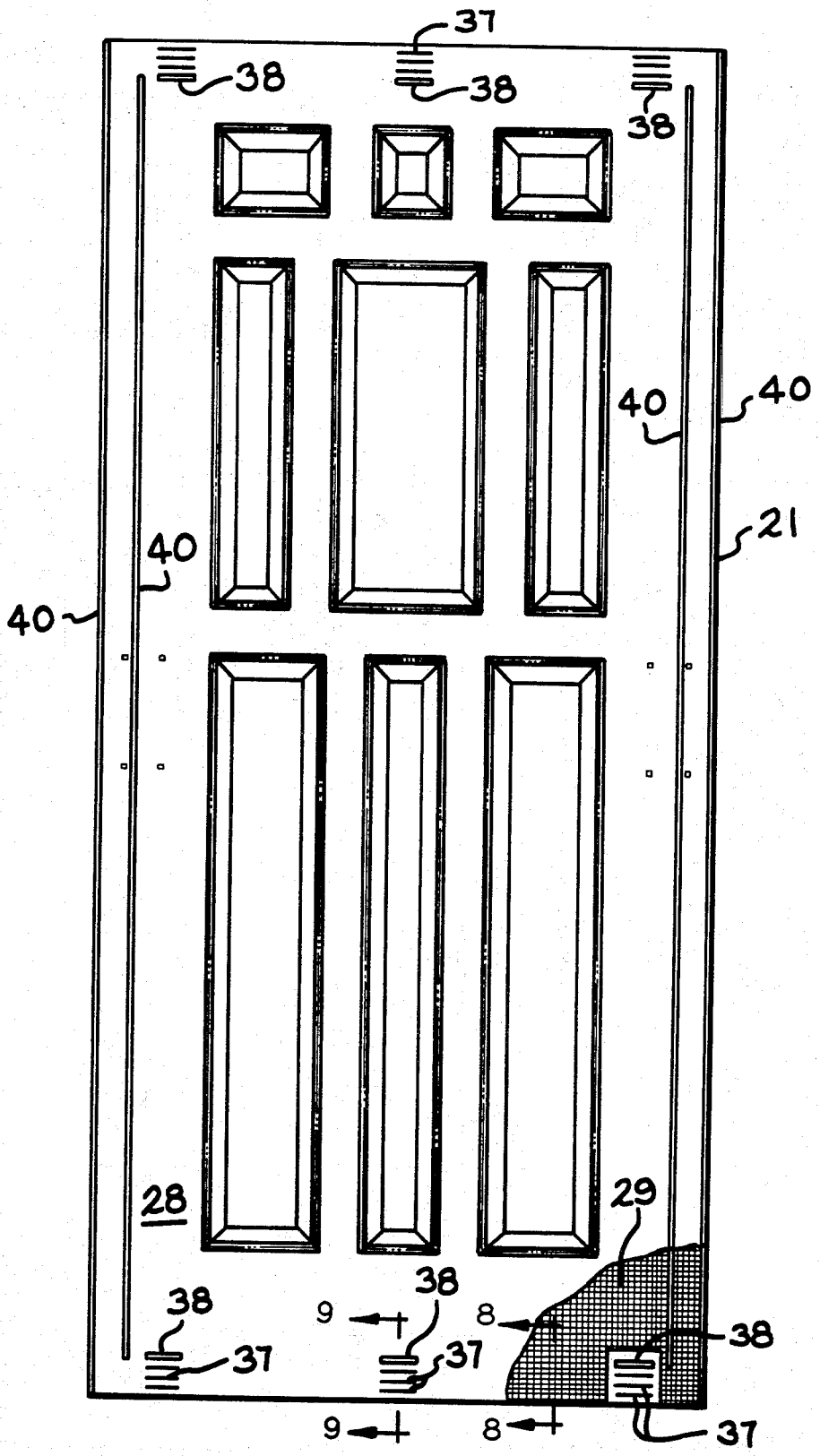
FIG. 2, is the reverse side of one panel or skin of the compression molded door assembly shown in FIG. 1 and further showing an inner texture in the lower right-hand corner.

Referring to FIG. 2, which depicts the inner side 28 of the skin 21, a random texture 29 is molded into the skin 21. The random texture 29 on the inner side 28 has a depth of between 0.003 inch and 0.009 inch. The random texture 29 aids in the adherance of the foam core 24 to the opposed skins 21, 22.

Preferably, the inner side 28 of the skin 21 is also essentially devoid of glass fibers for a predetermined depth of at least 0.005 inch. The inner side 28 normally is essentially devoid of glass fibers for a depth of between 0.005 inch and 0.009 inch.

The elimination of glass fibers from the surface of the exterior side 26 provides the present structure with several advantages. First it allows the fine grain texture 27 to be placed in the surface to a defined depth without exposing glass fibers. The prevent wicking and other inherent fibrous glass problems from occurring. At the same time, it allows the fibrous glass reinforcement to be distributed closer to the centroid of the skin. This results in a door structure which reduces deflection.

The perimeter frame 23, in the present embodiment, is a wood perimeter frame constructed of finger-jointed pine. The perimeter frame 23 is adhesively bonded to the inner and outer compression molded skins 21, 22. The core 24 comprises a rigid urethane foam having a density of 0.8 pounds per cubic foot to 3.5 pounds per cubic foot.

Referring to FIG. 1, the perimeter frame 23 extends outwardly from the edge 31 of the panels or skins 21, 22. The extension is 0.25 inch from the vertical edge 31 of the skin 21. This permits the trimming of the door assembly 20 with conventional woodworking tools. Also, the assembly 20 can be sized in length or lite openings may be cut using such conventional tools.

Figure 3:
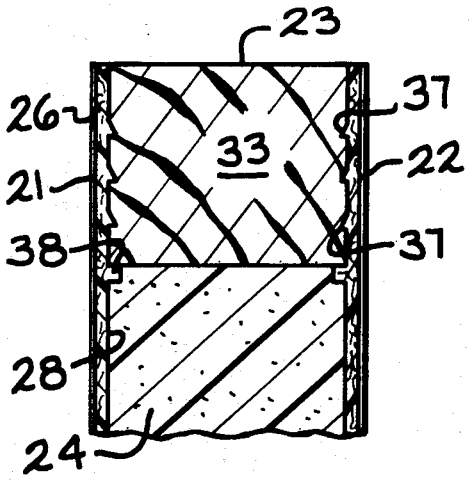
FIG. 3, is an enlarged fragmentary section view taken along the line 3—3 of FIG. 1.
Figure 4:
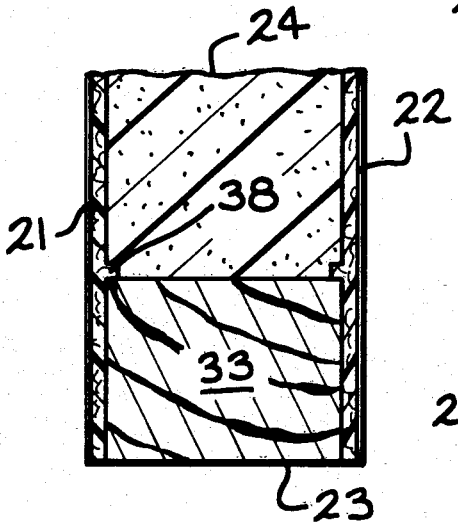
FIG. 4, is an enlarged fragmentary section view taken along line 4—4 of FIG. 1.
Figure 8:
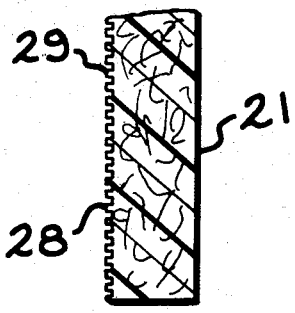
FIG. 8, is an enlarged fragmentary section view taken along the line 8—8 of FIG. 2.
Figure 9:
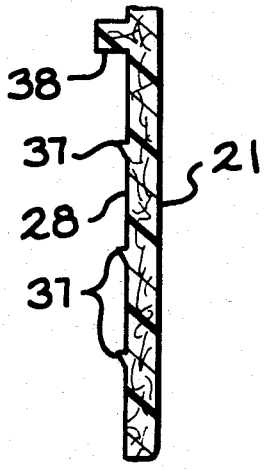
FIG. 9, is an enlarged fragmentary section view taken along the line 9—9 of FIG. 2.
Figure 7:
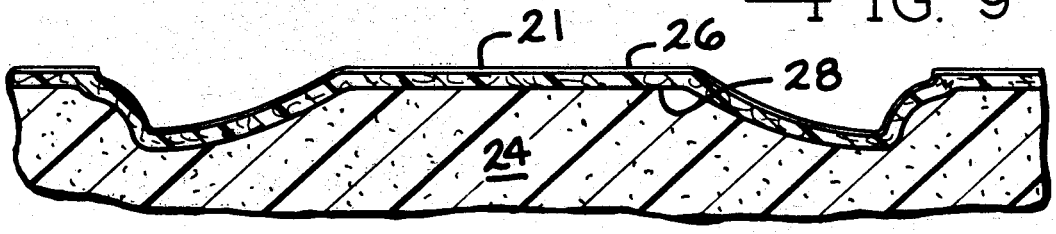
FIG. 7, is an enlarged fragmentary section view taken along the line 7—7 of FIG. 1.

The perimeter frame 23 includes horizontal rails 33 and vertical stiles 34. Referring to FIGS. 2 and 9, a plurality of horizontally extending grippers 37 having sharp outer edges, are molded on the inner sides 28 of the skins 21 and 22. A rail positioning member 38 also projects inwardly from the top and bottom surfaces of the inner sides 28 of the skins 21, 22. As shown in FIGS. 3 and 4, the rails 33 abut the rail positioning members 38. The grippers 37 pierce the surface of the rails 33 and aid in preventing undesired relative motion between the rails 33 and the skins 21, 22.

Figure 5:
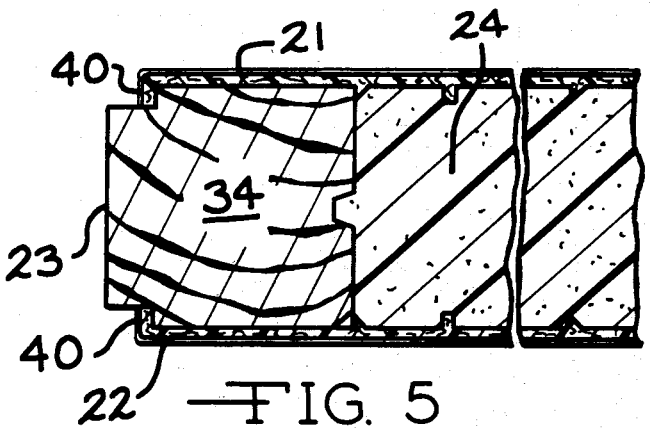
FIG. 5, is an enlarged fragmentary section view taken along the line 5—5 of FIG. 1.
Figure 6:
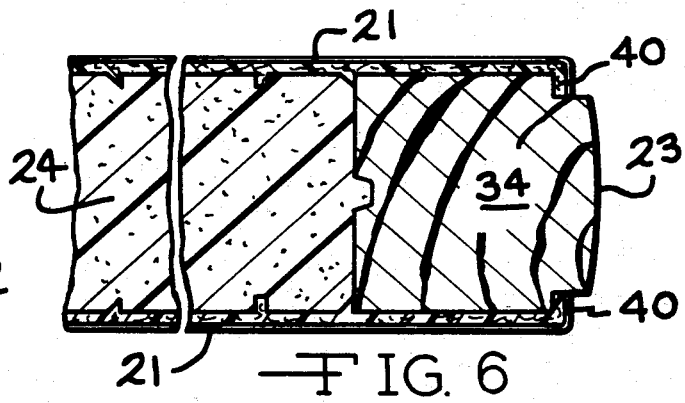
FIG. 6, is an enlarged fragmentary section view taken along the line 6—6 of FIG. 1.

A plurality of vertically extending projections 40 are positioned inwardly from the inner sides 28 of the skins 21, 22. As best shown in FIGS. 5 and 6, the projections 40 engage the stiles 34 of the perimeter frame 23. In the present embodiment, a pair of the vertically extending projections 40 are provided or defined along each edge of the skin 21 or 22.

It has been found that a compression molded door assembly 20, as described above provides a door assembly which has the dimensional stability in various environmental conditions together with a pleasing appearance. It has been found that the exterior surface of the door assembly 20 may be stained with a wood stain or with a topcoat, such as a clear urethane or acrylic topcoat.

While the present embodiment shown in FIG. 1, is directed to a nine unit "raised panel" design, simulating a wood door having a similar appearance, it is understood that various other designs may be constructed in accordance with the present invention without departing from the appended claims.

What I claim is:

1. A door assembly comprising, in combination, a rectangular frame, a pair of opposed compression molded skins mounted on said frame, and a foamed core positioned within said frame between and adhered to said opposed compression molded skins, said skins each having an outer side and an inner side, a vertically extending projection positioned on each vertical edge of said inner side of said compression molded skins, said projections engaging said rectangular frame, said compression molded skins being integral, including a molding resin and glass fibers, said outside of said skin being essentially devoid of glass fibers for a predetermined depth of at least 0.005 inch, said outer side of said skin defining a textured pattern simulating the grain and texture of a wood door, said textured pattern having a pattern depth between 0.003 inch and 0.009 inch, but not in excess of such predetermined depth.

2. A door assembly according to claim 1, wherein said outer side of said skin is essentially devoid of glass fibers for a predetermined depth of between 0.005 inch and 0.009 inch.

3. A door assembly according to claim 1, wherein said frame extends outwardly from at least a portion of the edge of said skins, whereby such frame may be trimmed for insertion in a door opening.

4. A door assembly according to claim 1, wherein said inner side of each of said compression molded skins also defines a molded textured pattern, said foamed core adhering to said textured pattern on said inner side.

5. A door assembly according to claim 1, wherein said skins are constructed of a glass fiber reinforced polyester resin, said skins having a thickness of between 0.050 inch and 0.120 inch.

6. A door assembly, according to claim 1, wherein said foamed core comprises a rigid urethane foam having a density between 0.8 and 3.5 lbs./ft.$^3$.

7. A door assembly, according to claim 1, wherein said rectangular frame is constructed of wood, a plurality of horizontally extending grippers defined on said inner side of compression molded skins adjacent said rectangular frame, said grippers piercing said wood frame, whereby relative motion between said frame and said skins is retarded.

8. A door assembly, according to claim 1, including horizontally extending rail stops extending inwardly from said inner side of said compression molded skins, said rail stops engaging the rails of said rectangular frame.

9. A door assembly, according to claim 1, wherein a pair of vertically extending projections are defined along each vertical edge of the inner side of each skin.

10. A door assembly comprising, in combination, a rectangular frame, a pair of opposed compression molded skins mounted on said frame, and a foamed core positioned within said frame between and adhered to said opposed compression molded skins, said skins having a thickness of between 0.050 inch and 0.120 inch, said skins each having an outer side and an inner side, said compression molded skins being integral, including a molding resin and glass fibers, said outer side of said skin being essentially devoid of glass fibers for a predetermined depth of at least 0.005 inch, said outer side of said skin defining a textured pattern simulating the grain and texture of a wood door, said textured pattern having a pattern depth between 0.003 inch and 0.009 inch, but not in excess of such predetermined depth, at least one vertically extending projection adjacent each vertical edge of said inner side of said skins, at least one of said projections engaging said perimeter frame, said frame extending outwardly from at least a portion of the edge of said skins, whereby such frame may be trimmed for insertion in a door opening, said foamed core comprises a rigid urethane foam having a density between 0.8 and 3.5 lbs/ft.$^3$.

11. A door assembly comprising, in combination, a rectangular frame, a pair of opposed compression molded skins mounted on said frame, and a foamed core positioned within said frame between and adhered to said opposed compression molded skins, said skins each having an outer side and an inner side, a pair of vertically extending projections defined along each vertical edge of the inner side of each skin, said compression molded skins being integral, including a molding resin and glass fibers, said outside of said skin being essentially devoid of glass fibers for a predetermined depth of at least 0.005 inch, said outer side of said skin defining a textured pattern simulating the grain and texture of a wood door, said textured pattern having a pattern depth between 0.003 inch and 0.009 inch, but not in excess of such predetermined depth.

12. A door assembly comprising, in combination, a rectangular frame, a pair of opposed compression molded skins mounted on said frame, said rectangular frame being constructed of wood, a plurality of horizontally extending grippers defined on said inner side of said compression molded skins adjacent said rectangular frame, said grippers piercing said wood frame, whereby relative motion between said frame and said skins is retarded, and a foamed core positioned within said frame between and adhered to said opposed compression molded skins, said skins each having an outer side and an inner side, said compression molded skins being integral, including a molding resin and glass fibers, said outside of said skin being essentially devoid of glass fibers for a predetermined depth of at least 0.005 inch, said outer side of said skin defining a textured pattern simulating the grain and texture of a wood door, said textured pattern having a pattern depth between 0.003 inch and 0.009 inch, but not in excess of such predetermined depth.

13. A door assembly comprising, in combination, a rectangular frame, a pair of opposed compression molded skins mounted on said frame, and a foamed core positioned within said frame between and adhered to said opposed compression molded skins, said skins each having an outer side and an inner side, horizontally extending rail stops extending inwardly from said inner side of said compression molded skins, said rail stops engaging the rails of said rectangular frame, said compression molded skins being integral, including a molding resin and glass fibers, said outside of said skin being essentially devoid of glass fibers for a predetermined depth of at least 0.005 inch, said outer side of said skin defining a textured pattern simulating the grain and texture of a wood door, said textured pattern having a pattern depth between 0.003 inch and 0.009 inch, but not in excess of such predetermined depth.

* * * * *

US004550540C1

(12) EX PARTE REEXAMINATION CERTIFICATE (5167th)

United States Patent
Thorn

(10) Number: US 4,550,540 C1
(45) Certificate Issued: Aug. 2, 2005

(54) COMPRESSION MOLDED DOOR ASSEMBLY

(75) Inventor: John E. Thorn, Sylvania, OH (US)

(73) Assignee: Therma-Tru Corp., Toledo, OH (US)

Reexamination Request:
No. 90/004,947, Mar. 24, 1998
No. 90/005,211, Nov. 30, 1998
No. 90/006,095, Aug. 24, 2001

Reexamination Certificate for:
Patent No.: 4,550,540
Issued: Nov. 5, 1985
Appl. No.: 06/594,549
Filed: Mar. 29, 1984

Related U.S. Application Data

(63) Continuation-in-part of application No. 06/456,400, filed on Jan. 7, 1983, now abandoned.

(51) Int. Cl.[7] ..... E06B 3/36; E04C 2/284; E04C 2/296

(52) U.S. Cl. ..... 52/309.4; 52/313; 52/456; 52/784.15; 52/309.9

(58) Field of Search ..... 52/309.4, 309.9, 52/309.11, 455, 456, 479, 784.15

(56) References Cited

U.S. PATENT DOCUMENTS

| | | | | |
|---|---|---|---|---|
| 2,873,718 | A | | 2/1959 | Brautigam |
| 3,263,370 | A | | 8/1966 | Martinez |
| 3,286,424 | A | | 11/1966 | Weyant |
| 3,334,464 | A | | 8/1967 | Charles |
| 3,359,699 | A | | 12/1967 | Jackson |
| 3,404,502 | A | | 10/1968 | Miller |
| 3,423,878 | A | | 1/1969 | Kimmel |
| 3,437,517 | A | | 4/1969 | Eilerman |
| 3,459,585 | A | | 8/1969 | Killmeyer |
| 3,512,304 | A | | 5/1970 | Meuret |
| 3,573,145 | A | | 3/1971 | Witkosky |
| 3,619,252 | A | | 11/1971 | Roacher |
| 3,655,353 | A | | 4/1972 | Nalley |
| 3,661,688 | A | | 5/1972 | Wheeler |
| 3,718,448 | A | | 2/1973 | Drummond |
| 3,748,222 | A | | 7/1973 | Wheeler |
| 3,786,609 | A | | 1/1974 | Difazio |
| 3,815,657 | A | * | 6/1974 | Malek et al. |
| 3,829,337 | A | | 8/1974 | Cheng |
| 3,887,389 | A | | 6/1975 | Hedden |
| 3,950,894 | A | * | 4/1976 | DiMaio |
| 3,985,175 | A | | 10/1976 | Pukl |
| 4,003,163 | A | | 1/1977 | Schmidt |
| 4,031,665 | A | | 6/1977 | Abramson |
| 4,049,415 | A | | 9/1977 | Dent, Jr. |
| 4,058,386 | A | | 11/1977 | Faulkner |
| 4,072,548 | A | | 2/1978 | Gerson |
| 4,084,347 | A | | 4/1978 | Brown |
| 4,114,319 | A | | 9/1978 | Governale |
| 4,146,375 | A | | 3/1979 | MacPherson |
| 4,152,876 | A | * | 5/1979 | Seely |
| 4,155,200 | A | | 5/1979 | Emanuel |
| 4,164,485 | A | | 8/1979 | Girgis |
| 4,173,113 | A | | 11/1979 | Snellman |
| 4,236,365 | A | | 12/1980 | Wheeler |
| 4,281,493 | A | * | 8/1981 | Pitt ..... 428/319.3 |
| 4,327,535 | A | * | 5/1982 | Governale ..... 52/309.11 |
| 4,362,541 | A | | 12/1982 | Thompson |

OTHER PUBLICATIONS

Al Lees, "Two Ways to Plastic Door Entry", Popular Mechanics, Jun. 1973, pp. 100–101.*
Owens/Corning Fiberglas Corporation, brochure titled "Fiberglas Entrance Door", 4 pages, Oct. 1972.*
The "Fiber Classic" Door Program, Oct. 24, 1980.

* cited by examiner

*Primary Examiner*—Robert J Canfield

(57) ABSTRACT

A compression molded door assembly is disclosed. A pair of compression molded skins are mounted on a rectangular perimeter frame which extends outwardly from the edges of the skins. The compression molded skins include a molding resin and reinforcing glass fibers. The outer surface of the skin is essentially devoid of glass fibers for a predetermined distance. A foamed core is positioned within the frame in adhering relationship to the opposed skins. A texture is molded on the exterior of the skins which simulates the grain and texture of a wood door.

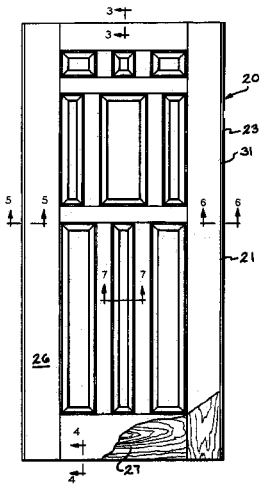

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–13 is confirmed.

* * * * *